US008092074B2

(12) United States Patent
Hahn et al.

(10) Patent No.: US 8,092,074 B2
(45) Date of Patent: Jan. 10, 2012

(54) ROTARY PUMP, HYDRODYNAMIC MIXER WITH A ROTARY PUMP, AND ALSO THE USE OF THE ROTARY PUMP FOR THE PROCESSING OF FLUIDS

(75) Inventors: Juergen Hahn, Marlborough, MA (US); Shui-Yuan Yu, Littau (CH)

(73) Assignee: Levitronix Technologies, LLC, Waltham, MA (US)

( * ) Notice: Subject to any disclaimer, the term of this patent is extended or adjusted under 35 U.S.C. 154(b) by 1023 days.

(21) Appl. No.: 11/656,064

(22) Filed: Jan. 19, 2007

(65) Prior Publication Data

US 2007/0193635 A1 Aug. 23, 2007

(30) Foreign Application Priority Data

Feb. 23, 2006 (EP) ..... 06405079

(51) Int. Cl.
*B01F 5/12* (2006.01)

(52) U.S. Cl. ..... 366/137; 366/262; 366/273; 417/420

(58) Field of Classification Search ..... 366/136–137, 366/273–274, 262–270, 314; 464/29; 403/DIG. 1; 416/3; 435/302.1; 417/420
See application file for complete search history.

(56) References Cited

U.S. PATENT DOCUMENTS 865,793 A * 9/1907 Morrison ..... 127/14
1,311,964 A * 8/1919 Grosvenor ..... 106/216.1
1,496,641 A * 6/1924 Hurrell ..... 241/146
1,752,434 A * 4/1930 Howard ..... 261/123
1,763,379 A * 6/1930 Thurm et al. ..... 241/46.11
1,768,927 A * 7/1930 Peters ..... 366/264
1,850,150 A * 3/1932 Horn ..... 366/264
1,976,955 A * 10/1934 MacLean ..... 366/264
2,134,571 A * 10/1938 Morlock ..... 422/227
2,306,298 A 12/1942 Curtis
2,308,751 A * 1/1943 Guthrie et al. ..... 261/93
2,578,805 A * 12/1951 Johnson ..... 241/45
2,685,499 A * 8/1954 Hood ..... 423/554

(Continued)

FOREIGN PATENT DOCUMENTS

BE 437453 A 12/1939

(Continued)

*Primary Examiner* — Charles E Cooley
(74) *Attorney, Agent, or Firm* — Kilpatrick Townsend & Stockton LLP

(57) ABSTRACT

The invention relates to a rotary pump (1) including a rotor (3) arranged in a closed pump housing (2) which is in operative connection with a drive (5) for the pumping of a fluid (4), wherein an inlet opening (6) is provided at the pump housing (2) for the intake of the fluid (4) into the pump housing (2) and an outlet opening (7) is provided at the pump housing (2) for conveying the fluid (4) out of the pump housing into a storage container (8) which is at least partially filled with the fluid (4). In accordance with the invention the outlet opening (7) is arranged and designed at the pump housing in such a way that the fluid (4) can be conveyed out of the pump housing (2) through the outlet opening (7) to the storage container (8) directly and free of ducting. The invention further relates to a hydrodynamic mixer (100) with a rotary pump (1) in accordance with the invention and also to the use of the rotary pump (1) and of the hydrodynamic mixer (100) for the processing of a fluid (4).

18 Claims, 10 Drawing Sheets

U.S. PATENT DOCUMENTS

| | | | | | |
|---|---|---|---|---|---|
| 2,738,931 | A | * | 3/1956 | Schneider | 241/27 |
| 3,366,368 | A | * | 1/1968 | Hibbing | 366/137 |
| 3,481,586 | A | * | 12/1969 | Roberts | 366/264 |
| 3,572,649 | A | * | 3/1971 | Joel | 366/136 |
| 3,730,488 | A | * | 5/1973 | Gardner, Jr. | 366/262 |
| 3,914,964 | A | * | 10/1975 | Dietrich | 68/189 |
| 3,985,272 | A | * | 10/1976 | Rodth | 222/205 |
| 4,002,326 | A | * | 1/1977 | Brogli et al. | 366/264 |
| 4,408,891 | A | * | 10/1983 | Schirk et al. | 366/265 |
| 4,437,765 | A | * | 3/1984 | Seeger | 366/264 |
| 4,869,657 | A | * | 9/1989 | Kurokawa | 417/423.14 |
| 4,893,937 | A | * | 1/1990 | Braun | 366/136 |
| 4,938,606 | A | * | 7/1990 | Kunz | 366/134 |
| 5,121,857 | A | * | 6/1992 | Hutchinson | 222/318 |
| 5,219,422 | A | | 6/1993 | Sato | |
| 6,634,224 | B1 | * | 10/2003 | Schob et al. | 73/168 |

FOREIGN PATENT DOCUMENTS

| | | | | |
|---|---|---|---|---|
| EP | 0 300 251 | A2 | | 1/1989 |
| EP | 1 284 369 | A1 | | 2/2003 |
| GB | 2103099 | A | * | 2/1983 |
| JP | 2007224901 | A | * | 9/2007 |

* cited by examiner

ROTARY PUMP, HYDRODYNAMIC MIXER WITH A ROTARY PUMP, AND ALSO THE USE OF THE ROTARY PUMP FOR THE PROCESSING OF FLUIDS

CROSS-REFERENCES TO RELATED APPLICATIONS

This application claims the priority of European Application No. 06405079.2, filed on Feb. 23, 2006, the disclosure of which is incorporated herein by reference.

BACKGROUND OF THE INVENTION

The invention relates to a rotary pump, to a hydrodynamic mixer with a rotary pump of this kind and also to the use of the rotary pump for the processing of suspensions.

In many industrial processes, for example in the manufacture of semi-conductors and chips, it is necessary to mix suspensions in a controlled manner and to dispense them via nozzles or similar apparatus. Chemical-mechanical polishing processes (CMP, chemical-mechanical planarization), such as are used in the semi-conductor industry, are named as an important example. In processes such as these a suspension, usually termed a slurry, made of typically very fine solid material particles and a liquid is applied to a rotating wafer and serves there for the polishing or lapping of the very fine semi-conductor structure. Another example is the application of photo-resist onto the wafer, or the roughening of the surfaces of computer hard drives, in order to prevent an adhesion of the print heads/read heads by means of adhesive forces, in other words, by means of Van der Waals forces.

A dispensing apparatus which is in principle suitable for this and is known from the prior art is illustrated in FIG. 1. In order to differentiate the prior art from the embodiments of the present invention, those features which relate to features of apparatus from the prior art are provided with single or double prime symbols in the drawings, whereas the features of embodiments in accordance with the invention are not provided as such.

The known dispensing apparatus 1' of FIG. 1 includes a storage container 2', which is filled with the fluid, e.g. slurry. The storage container 2' has an outlet 4' to which a pressure line 5' is attached, which extends via recirculation pump R' to an inlet 6' at the storage container 2'. A plurality of extraction points 7' are provided in the pressure line 5' downstream of the recirculation pump R', which lead to nozzles or other apparatus—usually designated as a tool—with which the fluid is applied, for example onto the wafers. Each extraction point 7' is provided with a valve 8', in order to open or to close the flow connection to the respective apparatus. If all extraction points 7' are closed, the recirculation pump R' merely effects a circulation of the fluid and thus a slight locally limited stirring of the fluid in the storage container 2'.

The desired pressure, with which the fluid is conveyed through the pressure line 5' and the open extraction points and made available there, can be generated or influenced by pressure discharge of the fluid in the storage container 2'. In addition, an inlet 10' is provided at the storage container 2', through which a pressure medium can be brought into the storage container via a pressure control valve 11', as illustrated symbolically by the arrow G. A gas, for example nitrogen, is usually used as a pressure medium, with which an overpressure of 0.5 bar, for example, is maintained in the storage container 2'.

An apparatus of this kind does have disadvantages however. In order to generate the overpressure in the storage container 2', this has to be designed to be gas-tight, which is quite complicated apparatus-wise. Moreover, it is not straightforwardly possible, to fill new fluid into the storage container 2', if the filling level becomes too low. A change of the pressure in the storage container 2' and thus a change of the pumping pressure is also complicated and time-consuming. Furthermore, it is possible that the pressure medium (gas) enters the fluid or dissolves in the fluid, which can lead to undesired changes in the composition of the fluid.

However, a far greater problem, particularly in suspensions such as a slurry, for example, or in fluids which tend to separate or agglomerate, is to be seen in the fact that the circulation caused by the recirculation pump R' is as a rule far too weak and irregular to guarantee a movement of the fluid everywhere in the storage container 2' which is adequate for a constant mixing. For this reason, additional measures are often necessary in order to ensure an adequate movement or mixing of the fluid in the storage container 2' in the long term.

In contrast to this the apparatus for the mixing and dispensing of a fluid proposed in EP 1 318 306 B1 and illustrated in FIG. 2 already represents a significant advance.

The dispensing apparatus 1" of FIG. 2 proposed in EP 1 318 306 B1 can be used in a CMP process in the semi-conductor industry for example. In these processes, a suspension of fine solid material particles termed a slurry is applied on a rotating wafer in a liquid and serves there for the lapping or polishing of the very fine semi-conductor structures. The apparatus or tools not illustrated in FIG. 2 each include, for example, a nozzle or a different means by the use of which the fluid "F" can be applied to the wafer.

Within the context of this application the term "rotary pumps", which are also called centrifugal pumps, covers all those pumps which have a rotor or a vane, through the rotation of which an impulse is transmitted to the fluid to be pumped. The term "rotary pump" includes in particular centrifugal pumps, axial pumps and side channel pumps. In a rotary pump, the inlet and the outlet are typically in constant flow connection. There are therefore no valves provided between the pump inlet and the pump outlet for example.

In the example of FIG. 2 known from the prior art, the rotor 31" is arranged directly in the outlet of the storage container 2" for the mixing of the fluid F". The rotor 31" projects at least partly into the storage container 2" to mix the fluid F".

That is to say, this is a rotary pump with an open pump housing and not a rotary pump with a closed pump housing.

Thus the rotary pump 3" not only serves for the pumping of the fluid F", but above all as a stirrer, which mixes the fluid F" in the storage container. To this end the rotor 31" has a plurality of vanes 311" which are designed to be considerably larger than in known rotary pumps of comparable dimensions. The vanes 311" reach into the storage container 2" and ensure here (on rotation of the rotor 31") a certain circulation of the fluid F", as is suggested by the arrow Z".

The rotor 31" is arranged in a rotor housing 312", which forms a part of the wall of the storage container 2". The open, not closed, rotor housing 312" is an integral part of the storage container 2" here. It can also be secured to this as a separate part.

The rotary pump 3" further includes a stator 32" with a stator coil 322" to electrically drive the rotor 31". The stator 32" surrounds the rotor housing 312" and the stator 32" is designed as a stator of a so-called temple motor. This means that the stator 32" has a plurality of stator teeth connected by means of a flux return member, with each stator tooth being formed in an L-shape with one short limb and one long limb. The longer limb extends in each case parallel to the axis of rotation of the rotor and the shorter limb extends radially inwardly in the direction towards the rotary axis. The longer limbs carry the stator winding 322".

The apparatus of FIG. 2 further has a pressure line 41", through which the fluid F" can be pumped to the apparatus and tools already mentioned above and not illustrated in FIG. 2, by which the fluid F" can be brought onto a wafer, for example.

In order to achieve a notable through mixing of the fluid 2 with the apparatus of FIG. 2, it is essential that additional fixed vanes 21" are provided in the storage container, which first make a through mixing of the fluid F" in the operating state possible at all.

The reason for this becomes easily recognizable if one looks at an apparatus in accordance with FIG. 2*a*, which does not have any vanes 21" in the storage container. An apparatus of this kind is illustrated in FIG. 2*a* in a simplified manner.

The apparatus of FIG. 2*a* likewise includes a storage container 2" for a fluid F". A rotary pump 3" with a rotor 31" is provided at the base of the storage container 2". The rotor 311" rotates in the direction of the arrow 3000" in the tank 2". The pressure line 41" is not illustrated for reasons of clarity.

The only fundamental difference between the apparatus of FIG. 2*a* and the one illustrated in FIG. 2 is thus that the vanes 21" are absent.

The absence of the vanes 21" has massive consequences in the apparatus of FIG. 2*a*, as regards the ability to thoroughly mix the fluid F" in the container 2" of FIG. 2*a*. A through mixing of the fluid in the storage container 2" of FIG. 2*a* does not take place at all in practice.

This is because of the fact that the fluid F" in the storage container is coupled to the rotation of the rotor 31" and the fluid F" in accordance with the arrow P" is set into rotation in the same direction as the direction of rotation 3000" of the rotor 31", so that an eddy V", with a funnel-shaped liquid surface, also called a vortex V", forms in the container. Since at least near the rotor 31", or in the vicinity of the center of the storage container 2", the rotating vortex V" adopts approximately the rotational speed of the rotor 31", practically no more eddying takes place in the fluid F" and thus essentially no through mixing of the fluid F".

If, then, a good through mixing of the fluid F", which is preferably a suspension F", such as for example a slurry F", is to be guaranteed, vanes 21" as shown in FIG. 2 have to be provided, which prevent the formation of a stable vortex V", i.e. break up the rotating flow of fluid.

The disadvantages of the solution known from the prior art for a mixer in accordance with FIG. 2 are many. The construction is complicated, expensive and inflexible because the vanes 21" are essential in the storage container 2". That does not just mean a more complicated construction but also more complicated servicing because, for example, during work on the motor, the vanes have to be removed and inserted again in a complicated manner. The cleaning of the plant is made correspondingly difficult and the construction is ultimately expensive, not only as regards the acquisition, but also as regards repairs and servicing.

A far more serious disadvantage, however, is the inflexibility, conditioned by its construction, of the apparatus, known from the prior art. The important parameters, which determine the mixing process and, if a pressure line 41" is present, the pumping process, are substantially determined by the geometry of the apparatus or by the parts from which it is assembled. Thus, for example, the intensity or the quality of the through mixing of the fluid F" and 7, or the pumping power of the rotor 31", can only be influenced by the speed of revolution of the rotor 31" within certain limits, if at all. The hydrodynamics of the through mixing can hardly be adapted; that is to say, the distribution, size and geometry of the eddy in the storage container 2" are substantially determined by the geometry of the vanes 21", their size and arrangement in the storage container 2" and also the further components and parts of the storage container.

An adaptation of the apparatus in accordance with FIG. 2 to the mixing process, to the requirements, to the different fluids F" or to different mixing conditions, such as for example temperature, viscosity of the fluid F" etc., is not possible without considerable structural change.

Moreover, the pumping process and the mixing process are strictly coupled to one another and cannot be adapted without constructional changes.

SUMMARY OF THE INVENTION

It is an object of the present invention to make available a rotary pump and a hydrodynamic mixer with a rotary pump which do not have the named disadvantages. The dispensing apparatus should be flexible and simple to use and in particular should make an adequate through mixing of the fluid possible.

Embodiments of the invention which satisfy these objects are disclosed herein.

Further aspects disclosed herein relate to particularly advantageous embodiments of the invention.

The invention thus relates to a rotary pump, including a rotor arranged in a closed pump housing, the rotor being in operative connection with a drive for the pumping of a fluid, with an inlet opening being provided at the pump housing for the intake of the fluid into the pump housing and an outlet opening being provided at the pump housing for conveying the fluid out of the pump housing into a storage container, which is at least partially filled with the fluid. In accordance with the invention, the outlet opening is arranged and designed at the pump housing in this arrangement in such a way that the fluid can be supplied from the pump housing through the outlet opening to the storage container directly and free of ducting.

It is thus important for the invention that the pump pumps the fluid through the outlet openings into the storage container, through which means an eddying and a very good through mixing of the fluid results, which can in particular be a suspension, such as, for example, a slurry. It is to be understood that the fluid can also be an emulsion or a mixture of two liquids, in particular of two liquids which can only be mixed with difficulty, which can be mixed thoroughly and ideally using the rotary pump in the storage container, in accordance with the invention.

In particular, since the through mixing is not undertaken by a rotating mixer, which is provided at or on the storage container, no stable eddy or vortex arises in the storage container, which prevents a good through mixing of the fluid, or at least massively impairs it. In fact, an ideal through mixing is achieved by means of the direct and duct-free direct pumping of the fluid into the storage container through the one or more outlet openings. This is because, on the one hand, the entire volume of the storage container is ideally thoroughly mixed by the fluid flowing out of the outlet openings into the storage container and, on the other hand, the outlet openings are not connected to an external pump circuit for conveying the fluid out of the storage container, but rather open directly into the storage tank without connection to an external line and can thus accomplish the function of the through mixing of the fluid in the storage container simply on its own.

The outlet openings in accordance with the present invention thus discharge substantially directly into the storage container. I.e. the fluid is conveyed out of the interior of the pump housing through the outlet openings, which, for example, can be formed simply as bores, nozzles or small tubular projections in the pump housing, directly into the storage container for the through mixing of the fluid located in the storage container, without a different use of the flow of fluid being possible on the path of the fluid from the interior of the pump housing via the outlet openings into the storage container. Thus the flow of fluid out of the interior of the pump housing through the outlet openings into the storage containers basically serves exclusively for the through mixing of the fluid in the storage container.

It has been shown in this connection that rotary pumps are decisive for the present invention because they deliver constant, i.e. steady-state, pressure ratios.

This is particularly important because, for example, the semi-conductor industry operates with increasingly finer suspensions; i.e. work is done with suspensions, which include particles with sizes down to and into the nanometer range, which are particularly difficult to mix thoroughly or in the case of which a continuously constant through mixing can only be maintained with difficulty. It is of particular significance here, but not only here, that constant, i.e. steady-state, pressure conditions can be realized, such as are made available by rotary pumps.

The advantages in comparison with an apparatus known from the prior art, such as for example shown in FIG. 1, are obvious. In the example illustrated in FIG. 1 the through mixing of the fluid in the storage container is negligibly small due to the return flow of the medium and, moreover, is directly coupled to the intensity of the use of the fluid between the output of the pump and the return flow point in the storage container. If, for example, much fluid is extracted between the output of the pump and the storage container, for example for use in a polishing process, then the return flow of the fluid into the storage container is small, whereby the already poor through mixing of the fluid in the storage container is reduced even further.

However, even in the extreme case, when no fluid is extracted between the output of the pump in the apparatus of FIG. 2 and the return flow point in the storage tank, for example, because no use of the fluid takes place, the through mixing of the fluid in the storage tank is still uselessly poor, due to the return flow of the fluid, because the whole geometry of the arrangement is designed for an ideal supply of the extraction points with fluid between the output of the pump and the return flow into the storage tank and not for an ideal through mixing in the storage tank. The return flow of the fluid into the storage tank merely serves for the return of unused fluid into the storage tank, so that it is not lost, but rather is available for further use.

However, the outlet openings of the rotary pump in accordance with the invention exclusively serve for the ideal through mixing of the fluid in the storage tank because they convey the fluid back again into the storage tank directly out of the interior of the pump housing, which is closed per se, so that the quality of the through mixing in the tank is guaranteed to remain the same all the time, even when, as will be explained below, in addition to the outlet openings, another supply opening is provided for the conveying of a part of the fluid into a supply line. This means that the conveying of the fluid through the outlet openings into the storage tank takes place independently of the fact that the rotary pump in accordance with the invention satisfies additional objects, in special embodiments for example the simultaneous conveying of the fluid into an external pump circuit for the use of the fluid in a certain application, for example for the polishing of a wafer.

In a preferred embodiment a supply opening, which can be connected to a pressure line, is provided at the pump housing for the conveying of the fluid into the pressure line. In this embodiment it is essential in this connection that the supply opening is in no way identical to the outlet opening at the pump housing, since the conveying of the fluid through the outlet opening into the storage container is any case separate from the flow of the fluid through a different opening of the pump housing, for example for the conveying of the fluid into the pressure line, in the sense that the entire amount of fluid which is conveyed out of the pump housing via the outlet opening into the storage container also reaches the storage container directly, that is to say, free of ducting. Thus the outlet opening and the supply opening are in any case two different, separate openings in the pump housing.

In a special embodiment the inlet opening and/or the outlet opening is provided in a cover of the pump housing, in particular in a removable cover of the pump housing, and can, for example, simply be formed by bores and/or short tubular projections, which reach into the storage container.

In a special case the inlet opening and/or the outlet opening has a circular cross-section and/or an oval cross-section and/or an elongated cross-section, in particular a rectangular and/or a ring-like shaped cross-section and/or another cross-section and/or a cross-sectional area of the outlet opening is between 10% and 100%, preferably between 30% and 70%, especially between 50% and 60% of a cross-sectional area of the inlet opening. I.e. the cross-sectional area of the outlet opening is preferably smaller than the cross-sectional area of the inlet opening. In this way it can be guaranteed that sufficient fluid can be taken in at any time, in order to also supply a plurality of outlet openings simultaneously with sufficient fluid, so that a uniform and sufficient through mixing of the fluid in the storage container is guaranteed. Moreover, a relatively small diameter of the outlet openings can lead to the fluid leaving the outlet openings at increased speed due to a nozzle effect, through which means a good through mixing in the storage container is further promoted.

In this connection and in special cases, a regulating means is provided at the inlet opening and/or at the outlet opening, with which the cross-section of the inlet opening and/or of the outlet opening can be altered, so that the flow of the fluid through the inlet opening and/or the outlet opening can be regulated by the regulating means. The regulating means can, for example, be provided as a valve, a screen, a shutter or as a different regulating means at or in the inlet opening and at or in the outlet opening.

A further optimization of the through mixing in the storage container can, for example, also be achieved by the inlet opening and/or the outlet opening being inclined at a predetermined angle in relation to an axis of the pump housing and/or by the outlet opening being designed as an outwardly directed inlet stub in relation to the pump housing, which can be formed as a short tubular projection, and/or the outlet opening can be formed as an outwardly directed outlet stub in relation to the pump housing, which can likewise be formed as a short tubular projection.

In a preferred embodiment the rotary pump has a stator for driving the rotor, with the rotor being journalled mechanically and/or magnetically, in particular contact-free relative to the stator and/or with the rotary pump being designed as a bearingless motor and/or the rotor being designed as an integral rotor and/or the rotor being permanently magnetic.

The invention further relates to a hydrodynamic mixer with a storage container for receiving a fluid to be mixed, with a rotary pump described above in accordance with the invention being provided.

In a special embodiment the rotary pump is arranged inside the storage container, in particular completely inside the store of fluid located in the storage container. This means the rotary pump does not, in particular, need to be fixedly or rigidly connected to the storage container, in order to form a hydrodynamic mixer in accordance with the invention.

In another embodiment the inlet opening of the rotary pump is connected to a supply tank via a supply line, so that the fluid can be conveyed out of the supply tank to the rotary pump and/or an additive can be supplied to the storage container from an additional container. This means that the inlet opening of the rotary pump can be connected to a further, externally disposed supply tank, from which, for example, fluid can be conveyed by means of gravity into the inlet opening of the rotary pump, so that the fluid can be conveyed through the outlet opening to the storage container for the through mixing and refilling of the storage container.

The inlet opening and/or the outlet opening in a hydrodynamic mixer in accordance with the invention is preferably, but not necessarily, provided in a cover of the pump housing, in particular in a removable cover of the pump housing, and/or the cover of the pump housing is arranged at a wall of the storage container, in particular at a base area of the storage container, and, in this special case, the cover forms a part of the wall, preferably a part of the base area of the storage container.

In another embodiment, in a hydrodynamic mixer, the fluid can be conveyed via the pressure line to an extraction point, and/or a means for controlling, and/or regulating a filling level in the storage container, and/or a means for controlling, and/or regulating an amount of additive is provided. The control and/or the regulation can preferably be aided or carried out by means of a programmable data processing unit.

The rotary pump in accordance with the invention and/or the hydrodynamic mixer in accordance with the invention is preferably used in this connection for the processing of suspensions, in particular of slurry, especially in a CMP process in a wafer production or the production of a computer hard drive and/or for the circulation and/or mixing and/or pumping of a suspension in a storage container and/or for the dissolving and/or mixing of a powder with a fluid, and/or for the manufacture of emulsions and/or for the through mixing and/or aerating of a bioreactor.

In this connection the rotary pump in accordance with the invention can, above all, be particularly advantageously used in cases where the fluid, for example a suspension such as slurry, tends to agglomerate and thus has to be kept moving all the time. In this arrangement, the rotary pump in accordance with the invention prevents the formation of dead zones in the storage container, in other words prevents the formation of regions in which the fluid is practically not moving, which makes it particularly suitable, as has been mentioned, for the use in suspensions which tend to agglomerate.

The invention will be explained more closely in the following with the help of the drawings.

DESCRIPTION OF THE PREFERRED EMBODIMENTS

Figure 1:
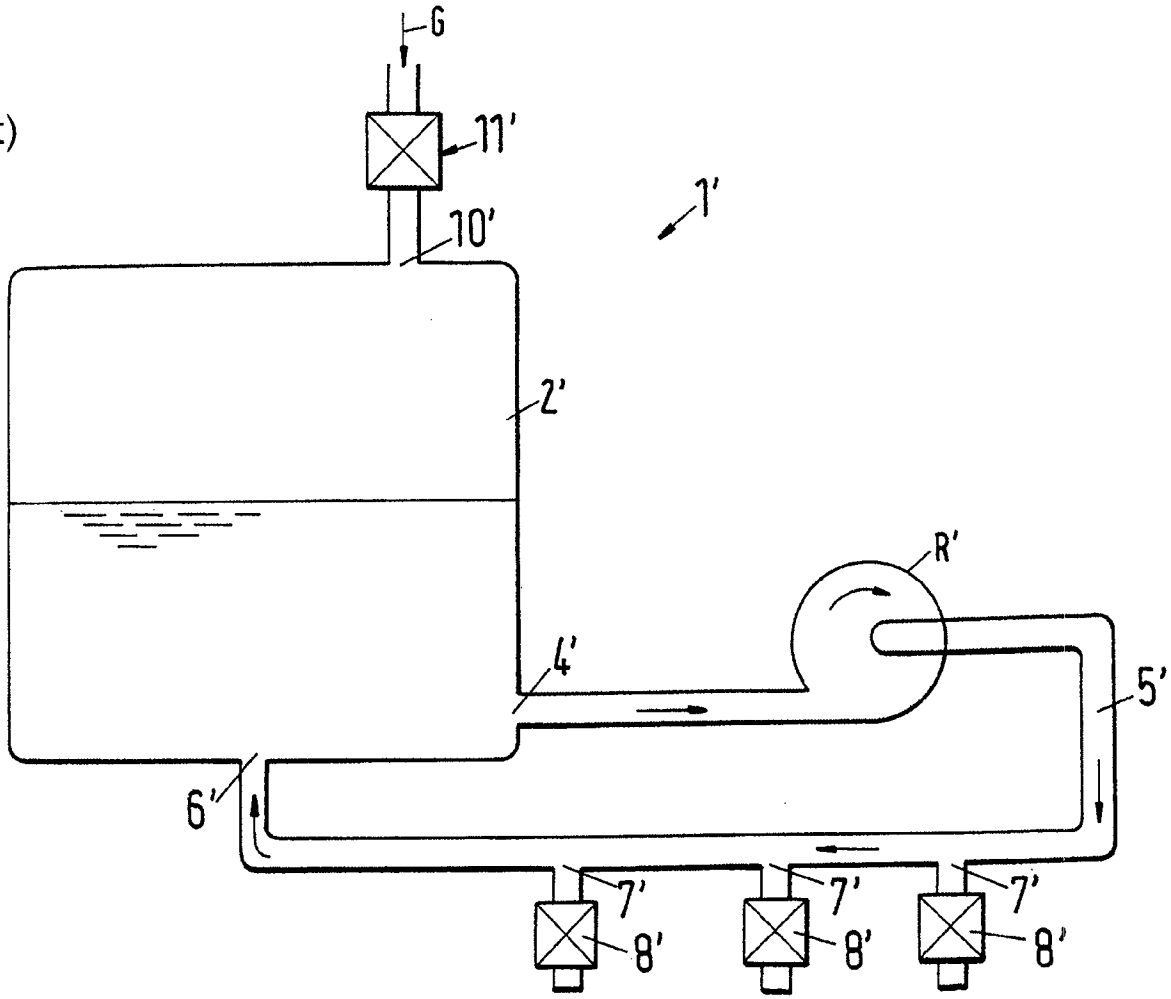
Fig.1 (Prior Art)
FIG. 1 is a mixing apparatus from the prior art.
Figure 2:
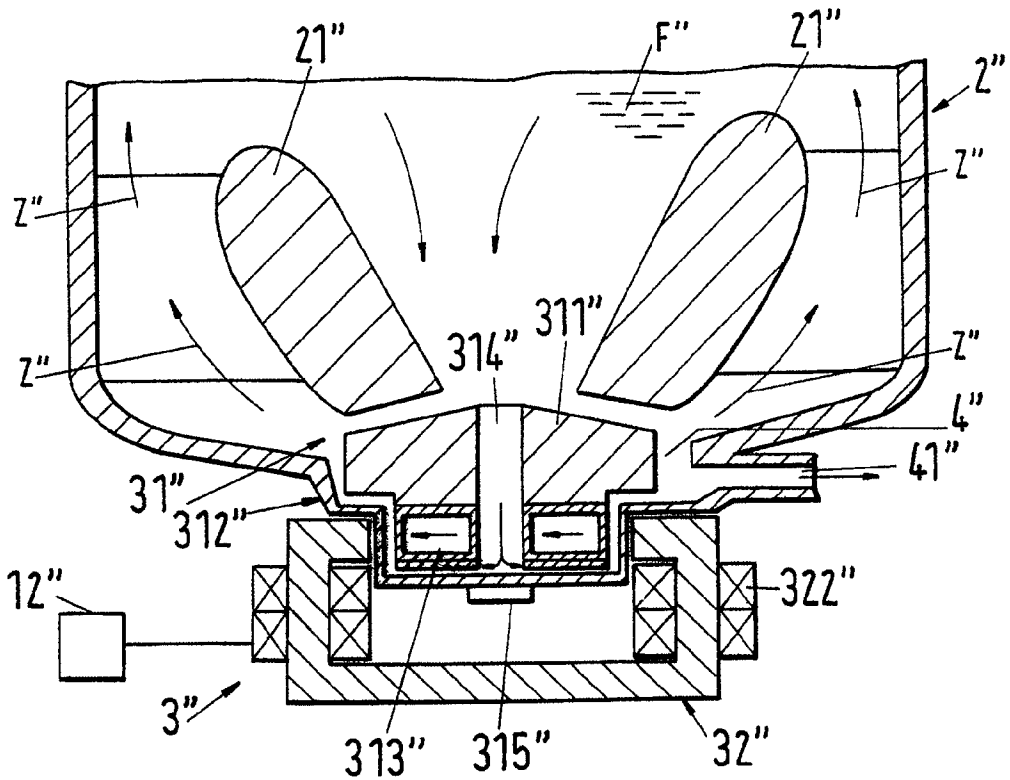
Fig.2 (Prior Art)
FIG. 2 is a known mixing apparatus with vanes for changing the flow direction.
Figure 2A:
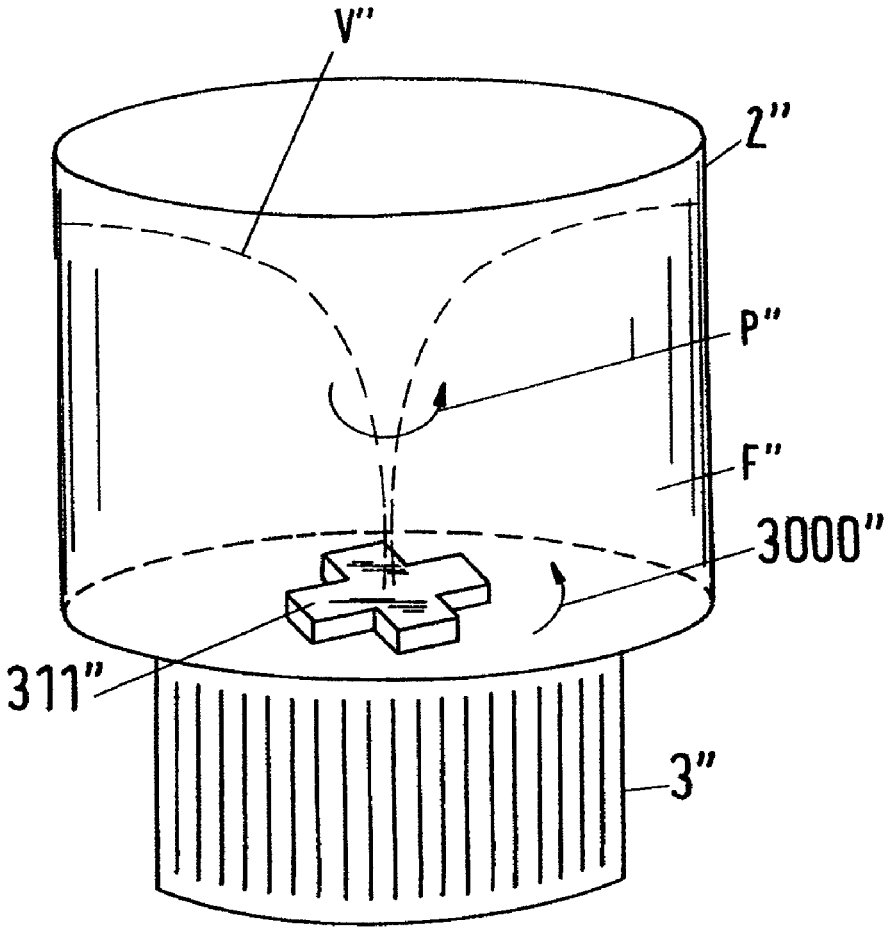
Fig.2a (Prior Art)
FIG. 2*a* is a mixing apparatus in accordance with FIG. 2 without vanes for changing the flow direction.

FIGS. 1, 2 and 2*a* relate to the prior art and have already been discussed in detail at the beginning of this specification, so that a further description of these drawings is not required at this point.

Figure 3A:
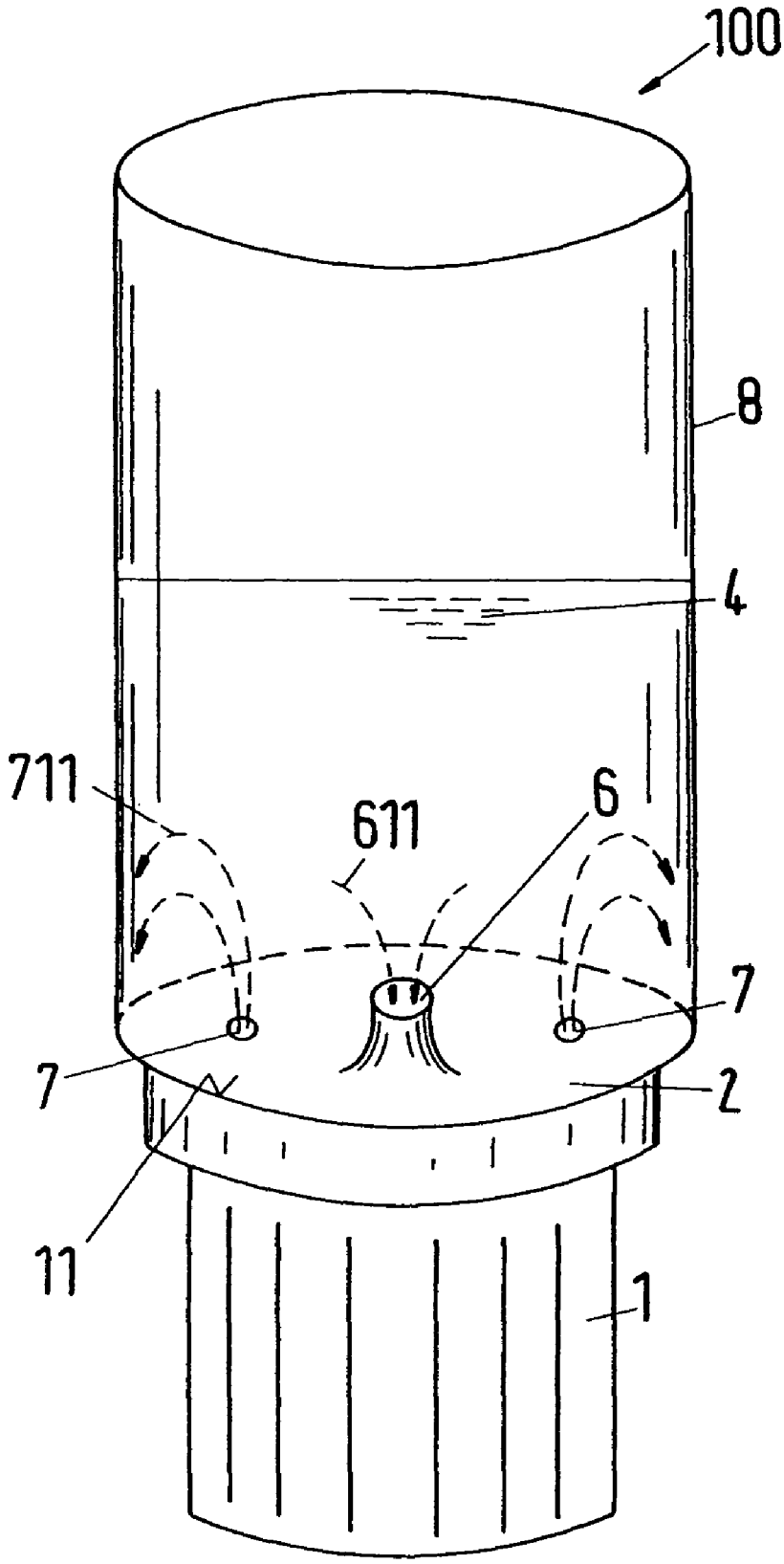
FIG. 3*a* is a hydrodynamic mixer in accordance with the invention.

FIG. 3*a* shows a simple first embodiment of a hydrodynamic mixer in accordance with the invention in schematic manner.

The embodiment of FIG. 3*a* is a purely hydrodynamic mixer 100, which only serves for the through mixing of the fluid and not for the simultaneous production of an additional pumping performance, for example in an external supply circuit. The hydrodynamic mixer 100 includes in this arrangement a storage container 8 for receiving a fluid 4, for example a slurry 4. The storage container 8 is mounted on a pump housing 2 of a rotary pump 1, so that the cover 11 of the pump housing 2 forms a base plate of the storage container 8.

As is suggested by the broken-line arrow 611, the fluid 4 is introduced in the operating state through the inlet opening 6 into the pump housing and is pumped back through the outlet openings 7 by the rotary pump 1, as shown by the arrow 711, into the storage container 8, by which a very good through mixing of the fluid 4 can be achieved in the storage container 8.

It has been shown in this arrangement, as already mentioned, that rotary pumps are decisive for the present invention, since they deliver constant, i.e. steady-state, pressure conditions. This is particularly important because, for example, work is done in the semi-conductor industry with ever finer suspensions, i.e. with suspensions which include particles with sizes down to and into the nanometer range, which are particularly difficult to mix thoroughly, or in which a continuous and constant through mixing can only be maintained with difficulty. It is particularly significant, particularly here, but not only here, that constant, i.e. steady-state, pressure conditions can be realized, such as are made available by rotary pumps.

Figure 3B:
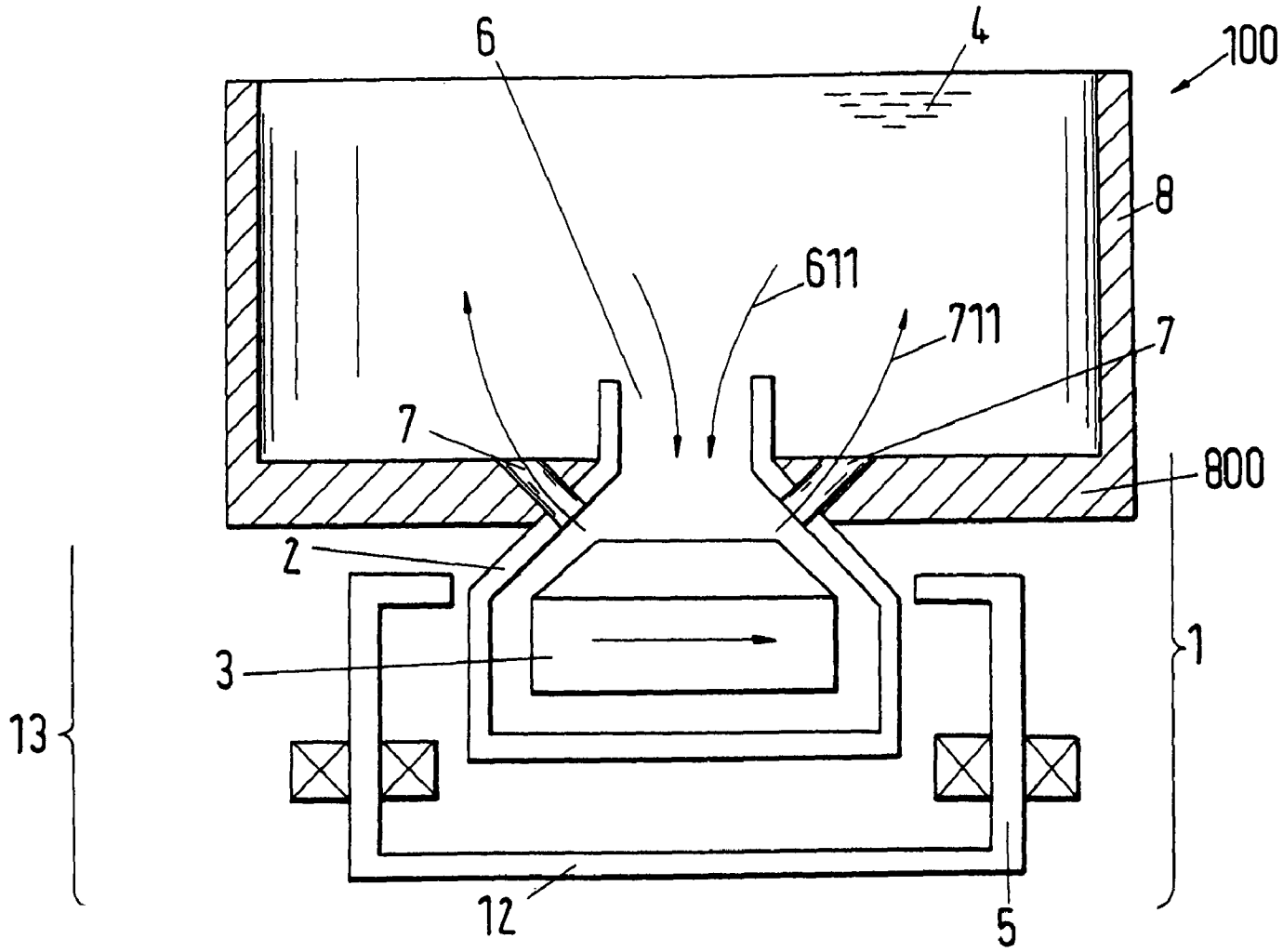
FIG. 3*b* is a mixer in accordance with FIG. 3*a* with a bearingless motor.

FIG. 3*b* shows a mixer 100 in accordance with FIG. 3*a* which is equipped with a bearingless motor. In this special embodiment the rotary pump 1 includes, in a known manner, a stator 12 for driving the rotor 3, wherein the rotor 3 is journalled mechanically and/or magnetically, in particular magnetically and contact-free in relation to the stator 12. I.e. the rotary pump 1 is preferably designed as a bearingless motor 13. In this special case the rotor 3 can be designed as an integral rotor 3 and is preferably permanently magnetic. A rotary pump 1 of this kind, which includes as a drive a contact-free magnetically journalled rotor 3, is always particularly advantageous when mechanically aggressive liquids have to be pumped, in other words suspensions with mechanically aggressive particles, which in usual, mechanically journalled pumps very quickly lead to the destruction of the mechanical bearings and other components of the pump. However, even if ultra-pure liquids or highly sensitive liquids or fluids from the chemical field, the pharmaceutical field, medicine, for example blood or other sensitive and/or ultra-pure materials, have to be conveyed, the use of a bearingless motor in accordance with FIG. 3*b* or in accordance with FIG. 3*d* is particularly suitable.

Figure 3C:
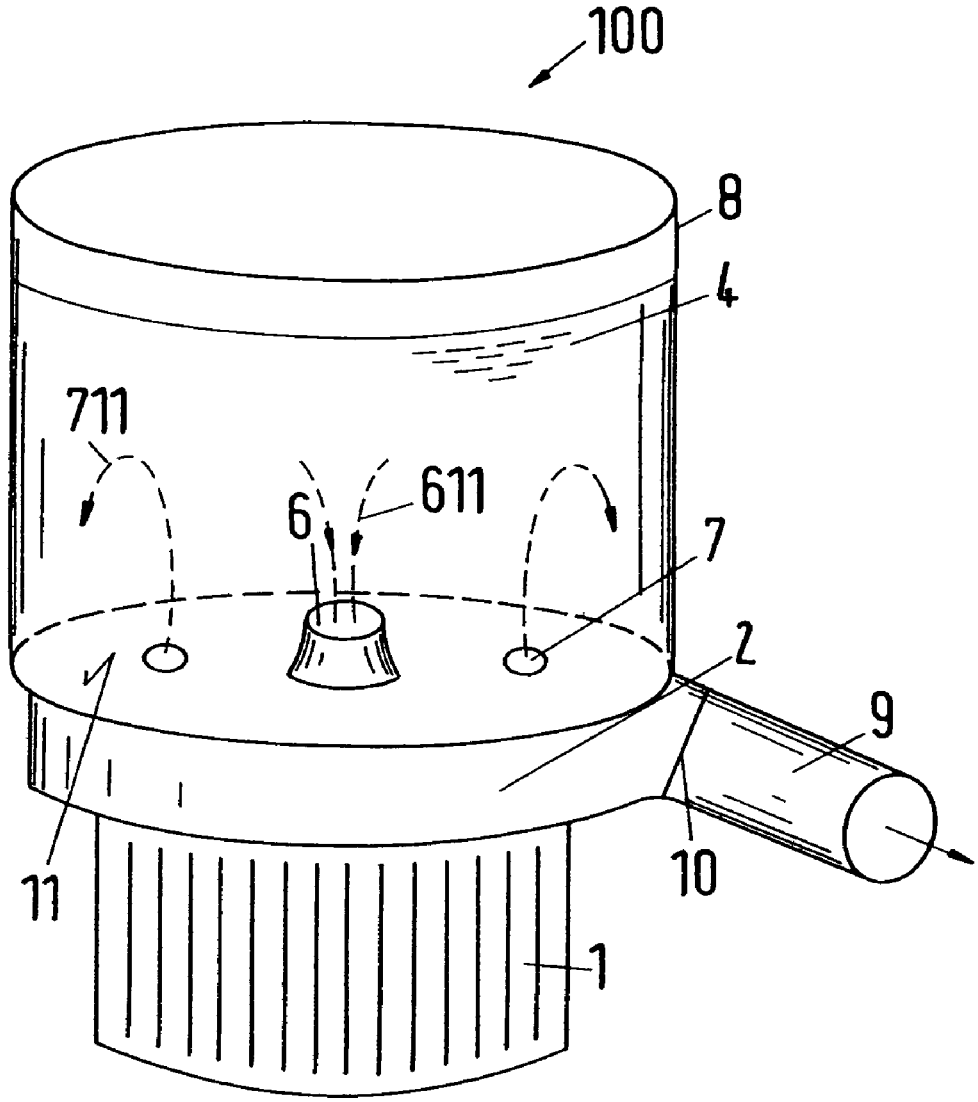
FIG. 3*c* is a mixer in accordance with FIG. 3*a* with a pressure line.
Figure 3D:
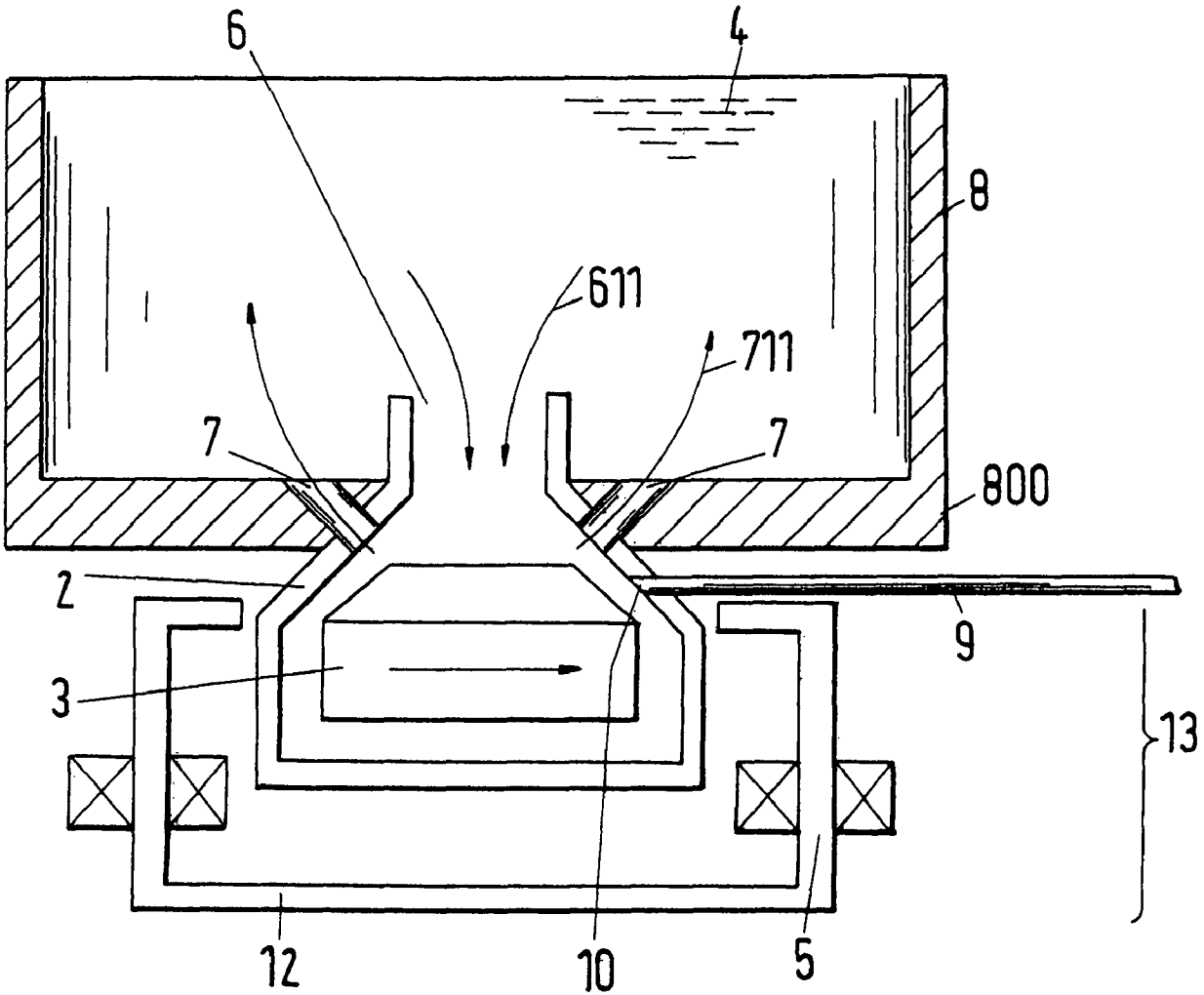
FIG. 3*d* is a mixer in accordance with FIG. 3*c* with a bearingless motor.

A further embodiment of a hydrodynamic mixer according to the invention in accordance with FIG. 3*a* is illustrated in FIGS. 3*c* and 3*d*. In the embodiments of FIGS. 3*c* and 3*d* a supply opening 10 is additionally provided, which can be connected to a pressure line 9, so that an external tool can be additionally supplied with fluid by means of the rotary pump 1. The external tool can be a polishing station for example, which serves for the polishing of wafers or any other device to which the well-mixed fluid 4 has to be conveyed. The example of FIG. 3*d* is merely a special embodiment in accordance with FIG. 3*c*, which includes a rotary pump with a bearingless motor as a rotary pump 1, as already described in FIG. 3*b*. It is important to stress once again that the supply opening 10 and the outlet opening 7 are in no way identical, that these are also not directly connected, such as is, for example, the case in the construction of FIG. 1 known from the prior art, but rather the fluid 4 can only pass from the outlet opening 7 to the supply opening 10, or vice versa, indirectly, for example via the pump housing 2.

It has to be stressed once again that all rotary pumps 1 in accordance with the invention are essentially closed rotary pumps 1, which substantially distinguishes these from the prior art as illustrated in FIG. 2 for example.

Figure 4:
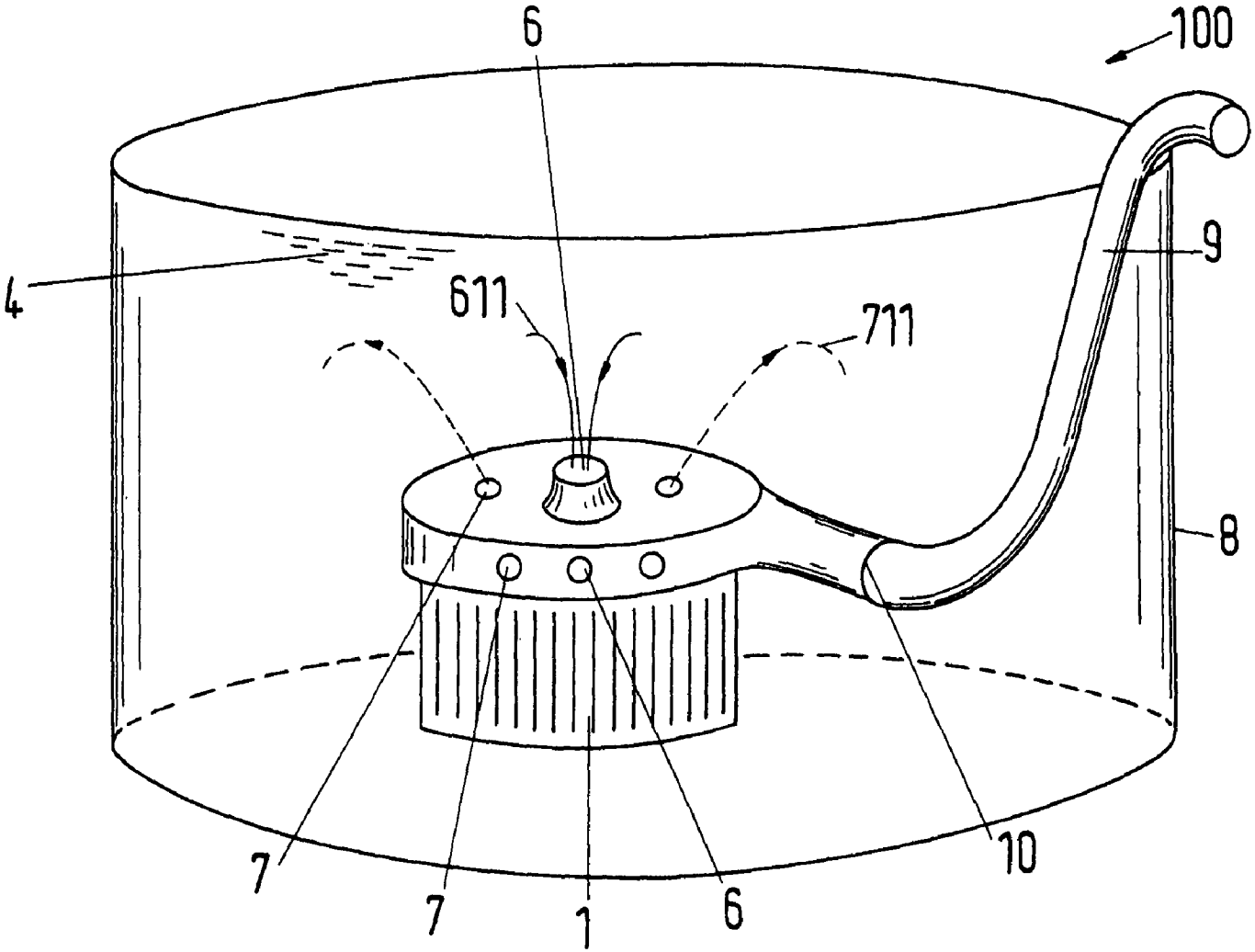
FIG. 4 is a storage container with a rotary pump in accordance with the invention.

A further embodiment of a hydrodynamic mixer 100 with a rotary pump 1 is illustrated in FIG. 4, in which the rotary pump 1 is placed completely inside the storage container 8. In this arrangement the rotary pump 1 can be fixed on the storage container 8 with fixing means, for example with screws, or simply without being fixed to the storage container 8 can simply be inserted in the storage container 8. In the special embodiment of FIG. 4 the mixer 100 additionally includes a supply opening 10 connected to a pressure line 9, so that in addition to the through mixing of the fluid 4, which is symbolically illustrated by the arrows 611 and 711 corresponding to FIGS. 3*a*-3*d*, fluid 4 can be simultaneously pumped by the rotary pump 1 via the pressure line 9 out of the storage container 8 for further processing.

It is to be understood that in another embodiment in accordance with FIG. 4, a rotary pump 1 can also be placed in the storage container 8, which has no additional supply opening and thus only serves the through mixing of the fluid 4.

Moreover, it is possible, as schematically illustrated in FIG. 4, that radial inlet openings 6 and/or radial outlet openings 7 can be provided, which can considerably improve the mixing of the fluid 4 in the storage container 8.

A particular advantage of the embodiment in accordance with FIG. 4 is to be found in the extraordinary flexibility of the arrangement. The rotary pump 1 can be placed in the storage container 8 in a particularly simple manner or can be removed from this, without expensive assembly work being necessary, so that above all the exchange of the rotary pump 1 or the repair or servicing of a unit of this kind can be carried out particularly simply and economically.

As an example, five different variants of a cover 11 of a pump housing 2 are schematically illustrated in FIGS. 5*a*-5*e*, which feature particular advantages, depending on the requirements, i.e. depending on the nature or characteristic of the fluid 4, the performance of the fluid 4 to be mixed, the size or geometry of the storage container 8, or depending whether or not a pumping performance has to be achieved in an external circuit via a supply opening 10, etc.

Figure 5B:
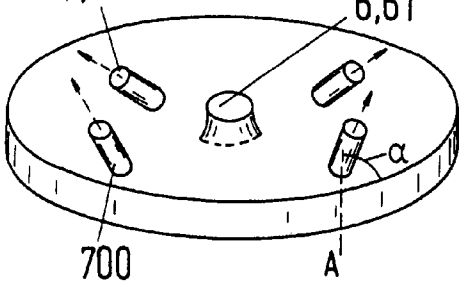
FIGS. 5*a-e* are five different embodiments of a cover of a pump housing.
Figure 5D:
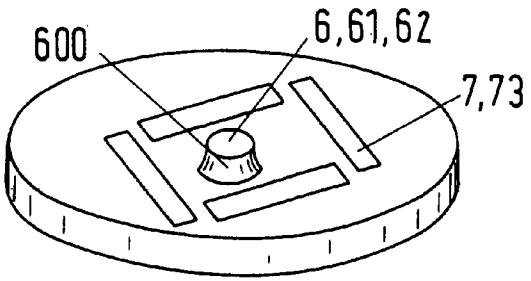
Figure 5A:
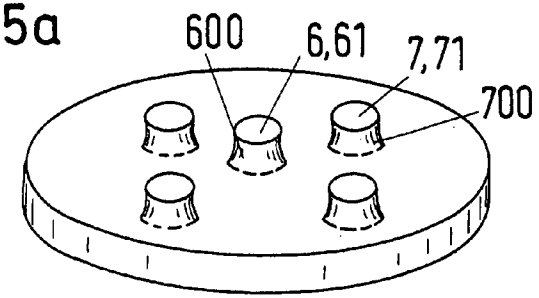
Figure 5C:
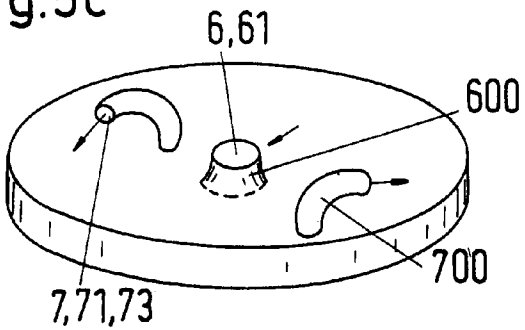
Figure 5E:
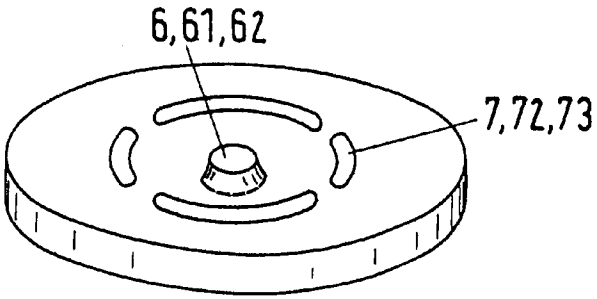

The inlet opening 6 and the outlet opening 7 can, as for example illustrated in FIGS. 5*a*, 5*b* and 5*c*, have a circular cross-section 61, 71 or, in accordance with FIG. 5*e*, the outlet opening 7 can have an oval, ring-like shape or an elongated cross-section 63, 73, in particular a rectangular cross-section 63, 73 in accordance with FIG. 5*d*. It goes without saying that all possible suitable combinations of the shown forms is possible, both at the inlet openings 6 and at the outlet openings 7. In particular more than one inlet opening 6 and/or more or less than four outlet openings 7 can be advantageously used, in each case in all possible variations and combinations, above all but not only of the special embodiments shown in FIGS. 5*a*-5*e* of cross-sectional areas 61, 71 and/or inlet stubs 6 and/or outlet stubs 7. It is to be understood that the inlet stubs 6 and/or the outlet stubs 7 can also extend considerably into the storage container 8, so that an even better mixing of the fluid 4 can be achieved. Thus the inlet stubs 6 and/or the outlet stubs 7 can be lengthened by means of hoses or tubes for example, with the hoses or tubes being able to be distributed in the storage containers 8 in a certain manner, so that the mixing can be optimized even further.

A cross-sectional area 71, 72, 73 of the outlet opening 7 is between 10% and 100%, preferably between 30% and 70%, especially between 50% and 60% of a cross-sectional area 61, 62, 63 of the inlet opening 6, and/or a regulating means not illustrated in FIGS. 5*a*-5*e* is provided at the inlet opening 6 and/or at the outlet opening 7, with which the cross-section 61, 62, 63 of the inlet opening 6 and/or of the cross-section 71, 72, 73 of the outlet opening 7 can be altered, so that the flow of the fluid 4 through an inlet opening 6 and/or through an outlet opening 7 can be regulated, or can be adjusted to a pre-determinable value.

It goes without saying that it is also possible that, for example, the angle $\alpha$, at which the outlet stub 700 and/or an inlet stub 600 can be inclined relative to an axis A of the pump housing 2, can be varied by suitable means, or can be adjusted to a pre-determinable value, by means of which the mixing of the fluid 4 in the storage container 8 can be further optimized.

Figure 6:
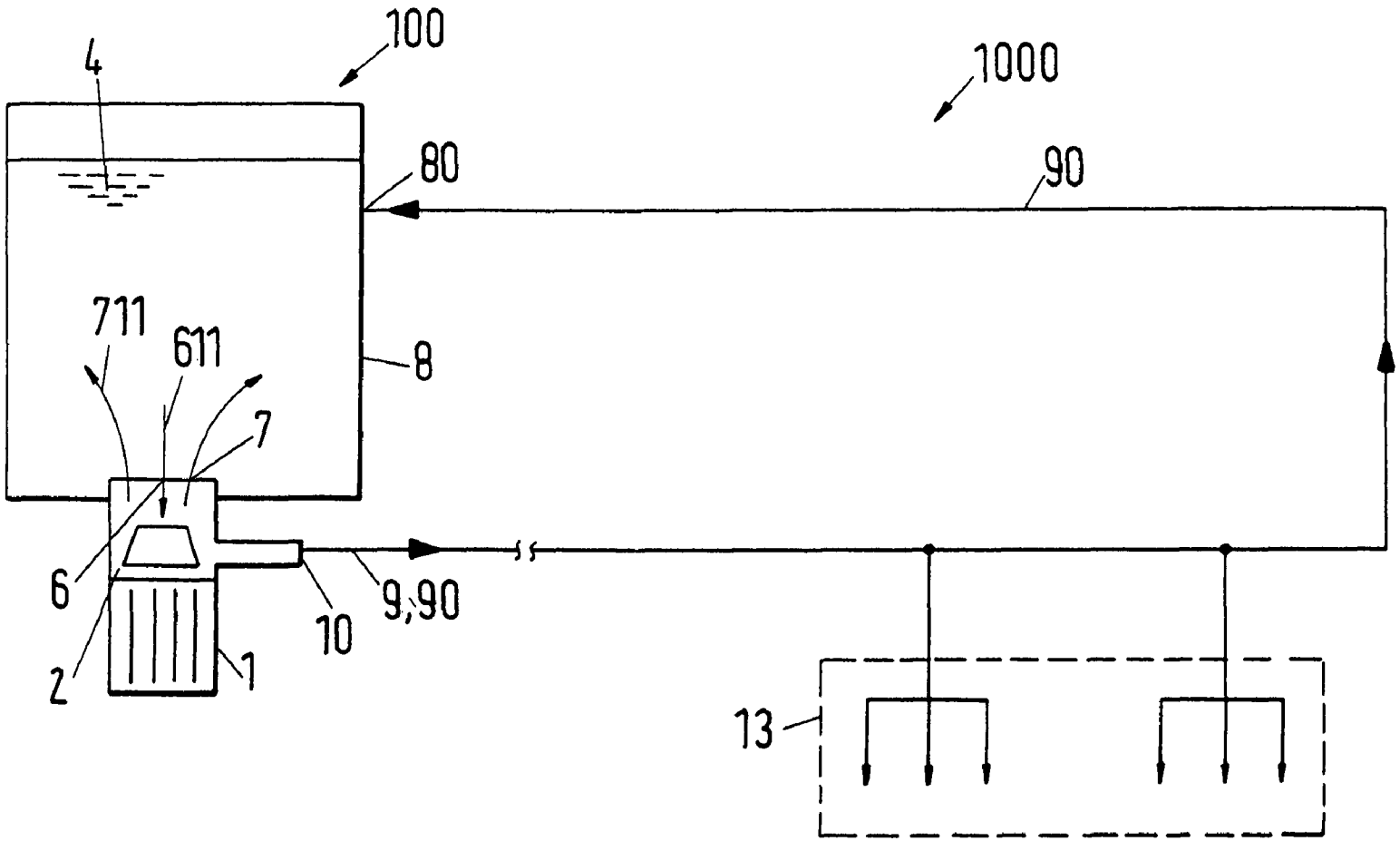
FIG. 6 is a dispensing apparatus with a rotary pump in accordance with the invention.

Finally, a complete dispensing apparatus 1000 with a hydraulic mixer 100 in accordance with the invention with a rotary pump 1 is schematically illustrated in FIG. 6.

The dispensing apparatus 1000 of FIG. 6 includes a storage tank 8 which, for example, contains a fluid 4 in the form of a slurry, which, for example, serves for the polishing of a wafer, which is to be polished in a not illustrated polishing apparatus, which is connected to the extraction point 13 for the supply of the fluid 4. For this, the slurry 4 is pumped by the rotary pump 1 in accordance with the invention out of the storage container 8 via the supply opening 10 into the pressure line 9, which in the present case is formed as a ring line 90, so that the fluid 4, which is not extracted at one of the extraction points 13, can be returned via the ring line 90 and the return flow opening 80 into the storage container 8 for further use.

In accordance with the present invention the fluid 4 is simultaneously ideally mixed in the storage container 8 by the rotary pump 1, in that, as has already been described in detail above, fluid is introduced into the pump housing 2 of the rotary pump 1 via the inlet opening 6, in accordance with the arrow 611, and is conveyed back through the outlet openings 7 into the tank again to mix the fluid 4.

It is to be understood that all embodiments in accordance with the invention described above are only to be understood as exemplary, and the invention includes in particular, but not only, all suitable combinations of the described embodiments.

The invention claimed is:

1. A rotary pump, including a rotor arranged in a closed pump housing which is in operative connection with a drive for the pumping of a fluid, wherein an inlet opening is provided at the pump housing for the intake of the fluid into the pump housing and an outlet opening is provided at the pump housing for conveying the fluid out of the pump housing into a storage container which is at least partially filled with the fluid, wherein the outlet opening is arranged at the pump housing such that the fluid is supplied from the pump housing through the outlet opening to the storage container directly and free of ducting, wherein the pump housing and the storage container are directly separated by a pump housing wall positioned therebetween, the inlet opening comprising a passage orientated in a first direction with respect to the pump housing wall, and wherein the outlet opening comprises a plurality of directional stubs extending from the pump housing wall into the storage container, the directional stubs having respective stub outlets directionally-configured, with respect to the pump housing wall, away from the first direction.

2. A rotary pump in accordance with claim 1, wherein a supply opening, that is connected to a pressure line for conveying the fluid into the pressure line, is provided at the pump housing.

3. A rotary pump in accordance with claim 1, wherein the inlet opening and/or the outlet opening are provided in a cover of the pump housing, and/or in a removable cover of the pump housing.

4. A rotary pump in accordance with claim 1, wherein the inlet opening and/or the outlet opening has a circular cross-section and/or an oval cross-section and/or an elongated cross-section, and/or a rectangular and/or a ring-shaped cross-section and/or another cross-section and/or wherein a cross-sectional area of the outlet opening is between 10% and 100%, or between 30% and 70%, or between 50% and 60% of a cross-sectional area of the inlet opening, and/or wherein a regulation means is provided at the inlet opening and/or at the outlet opening, with which the cross-section of the inlet opening and/or the cross-section of the outlet opening can be altered.

5. A rotary pump in accordance with claim 1, wherein the inlet opening and/or the outlet opening is/are inclined at a pre-determined angle in relation to an axis of the pump housing.

6. A rotary pump in accordance with claim 1, wherein the inlet opening is formed as an outwardly directed inlet stub in relation to the pump housing.

7. A rotary pump in accordance with claim 1, wherein the rotary pump has a stator to drive the rotor, wherein the rotor is journalled mechanically and/or magnetically, and/or magnetically and contact-free relative to the stator, and/or the rotary pump is a bearingless motor and/or wherein the rotor is an integral rotor and/or the rotor is permanently magnetic.

8. A hydrodynamic mixer with a storage container for receiving the fluid to be mixed, wherein the rotary pump in accordance with claim 1 is provided.

9. A hydrodynamic mixer in accordance with claim 8, wherein the rotary pump is arranged inside the storage container, or completely inside the store of fluid located in the storage container.

10. A hydrodynamic mixer in accordance with claim 8, wherein the inlet opening of the rotary pump is connected with a supply tank via a supply line, so that the fluid can be fed to the rotary pump out of the supply tank and/or wherein an additional material can be fed to the storage container from an additional container.

11. A hydrodynamic mixer in accordance with claim 8, wherein the pump housing wall comprises a cover of the pump housing, and/or a removable cover of the pump housing, and/or on a base area of the storage container.

12. A hydrodynamic mixer in accordance with claim 8, wherein the fluid can be pumped via a pressure line to a removal point and/or wherein means is provided for the controlling and/or the regulation of a fluid flow, and/or for the controlling and/or the regulation of a filling level in the supply container, and/or wherein means is provided for controlling and/or regulating a quantity of additive.

13. A rotary pump, including a rotor arranged in a pump housing which is in operative connection with a drive for the pumping of a fluid, wherein an inlet opening is provided at the pump housing for the intake of the fluid into the pump housing and an outlet opening is provided at the pump housing for conveying the fluid out of the pump housing into a storage container which is at least partially filled with the fluid, wherein the outlet opening is arranged at the pump housing such that the fluid is supplied from the pump housing through the outlet opening to the storage container directly and free of ducting, wherein the fluid within the pump housing is pressurized from the pumping of the fluid, and wherein the pump housing includes a supply opening to externally supply the pressurized fluid from the pump housing, wherein the pump housing and the storage container are directly separated by a pump housing wall positioned therebetween, the inlet opening comprising a passage orientated in a first direction with respect to the pump housing wall, and wherein the outlet opening comprises a plurality of directional stubs extending from the pump housing wall into the storage container, the directional stubs having respective stub outlets directionally-configured, with respect to the pump housing wall, away from the first direction.

14. A hydrodynamic mixer with a storage container for receiving the fluid to be mixed, wherein the rotary pump in accordance with claim 13 is provided.

15. A rotary pump, including a rotor arranged in a pump housing which is in operative connection with a drive for the pumping of a fluid, wherein an inlet opening is provided at the pump housing for the intake of the fluid into the pump housing and an outlet opening is provided at the pump housing for conveying the fluid out of the pump housing into a storage container which is at least partially filled with the fluid, wherein the outlet opening is arranged at the pump housing such that the fluid is directly supplied from the pump housing through the outlet opening to the storage container, wherein the rotor comprises a cylinder to intake the fluid in an axial direction into the cylinder and convey the fluid in a radial direction from the cylinder, wherein the pump housing and the storage container are directly separated by a pump housing wall positioned therebetween, the inlet opening comprising a passage orientated in a first direction with respect to the pump housing wall, and wherein the outlet opening comprises a plurality of directional stubs extending from the pump housing wall into the storage container, the directional stubs having respective stub outlets directionally-configured, with respect to the pump housing wall, away from the first direction.

16. A hydrodynamic mixer with a storage container for receiving the fluid to be mixed, wherein the rotary pump in accordance with claim 15 is provided.

17. A rotary pump, including a rotor arranged in a pump housing which is in operative connection with a drive for the pumping of a fluid, wherein an inlet opening is provided at the pump housing for the intake of the fluid into the pump housing and an outlet opening is provided at the pump housing for conveying the fluid out of the pump housing into a storage container which is at least partially filled with the fluid, wherein the outlet opening is arranged at the pump housing such that the fluid is supplied from the pump housing through the outlet opening to the storage container directly and free of ducting, wherein the drive includes a stator for driving the rotor, and wherein the rotor is journalled magnetically and contact-free from the stator, wherein the pump housing and the storage container are directly separated by a pump housing wall positioned therebetween, the inlet opening comprising a passage orientated in a first direction with respect to the pump housing wall, and wherein the outlet opening comprises a plurality of directional stubs extending from the pump housing wall into the storage container, the directional stubs having respective stub outlets directionally-configured, with respect to the pump housing wall, away from the first direction.

18. A hydrodynamic mixer with a storage container for receiving the fluid to be mixed, wherein the rotary pump in accordance with claim 17 is provided.

* * * * *